US010256019B2

(12) United States Patent
Ohwaki et al.

(10) Patent No.: US 10,256,019 B2
(45) Date of Patent: Apr. 9, 2019

(54) IRON-BASED SOFT MAGNETIC POWDER FOR DUST CORE, METHOD FOR MANUFACTURING THE SAME, AND DUST CORE

(71) Applicant: KOBE STEEL, LTD., Kobe-shi (JP)

(72) Inventors: Takeshi Ohwaki, Kobe (JP); Hiroyuki Mitani, Kobe (JP); Hirofumi Hojo, Takasago (JP); Kasumi Yanagisawa, Kobe (JP); Nobuaki Akagi, Takasago (JP)

(73) Assignee: KOBE STEEL, LTD., Kobe-shi (JP)

( * ) Notice: Subject to any disclaimer, the term of this patent is extended or adjusted under 35 U.S.C. 154(b) by 637 days.

(21) Appl. No.: 14/818,846

(22) Filed: Aug. 5, 2015

(65) Prior Publication Data

US 2015/0340138 A1 Nov. 26, 2015

Related U.S. Application Data

(62) Division of application No. 12/648,684, filed on Dec. 29, 2009.

(30) Foreign Application Priority Data

Feb. 24, 2009 (JP) ..... 2009-041090

(51) Int. Cl.

| | |
|---|---|
| ***H01F 1/20*** | (2006.01) |
| ***C23C 22/07*** | (2006.01) |
| ***C23C 22/82*** | (2006.01) |
| ***H01F 1/147*** | (2006.01) |
| ***H01F 41/00*** | (2006.01) |
| ***B22F 1/02*** | (2006.01) |
| ***H01F 1/24*** | (2006.01) |
| ***H01F 41/02*** | (2006.01) |
| *H01F 1/26* | (2006.01) |

(52) U.S. Cl.

CPC ..... *H01F 1/20* (2013.01); *B22F 1/02* (2013.01); *C23C 22/07* (2013.01); *C23C 22/82* (2013.01); *H01F 1/147* (2013.01); *H01F 1/24* (2013.01); *H01F 41/005* (2013.01); *H01F 41/0246* (2013.01); *B22F 2998/00* (2013.01); *C22C 2202/02* (2013.01); *H01F 1/26* (2013.01); *Y10T 428/12181* (2015.01)

(58) Field of Classification Search

None

See application file for complete search history.

(56) References Cited

U.S. PATENT DOCUMENTS

| | | | | |
|---|---|---|---|---|
| 2,528,787 | A * | 11/1950 | Roland | C23C 22/23 106/14.12 |
| 6,054,219 | A * | 4/2000 | Satsu | H01F 1/24 427/220 |
| 2007/0235109 | A1* | 10/2007 | Maeda | B22F 1/02 148/307 |
| 2008/0061264 | A1* | 3/2008 | Maeda | H01F 1/24 252/62.51 R |
| 2008/0117008 | A1* | 5/2008 | Komuro | B22F 3/26 335/302 |
| 2008/0232762 | A1* | 9/2008 | Kuramoto | C08G 77/42 385/145 |
| 2009/0242825 | A1* | 10/2009 | Ohwaki | B22F 1/02 252/62.54 |
| 2010/0051851 | A1 | 3/2010 | Mitani et al. | |
| 2010/0193726 | A1 | 8/2010 | Maeda et al. | |
| 2011/0068506 | A1 | 3/2011 | Kusawake et al. | |

FOREIGN PATENT DOCUMENTS

| | | |
|---|---|---|
| EP | 1 739 694 A1 | 1/2007 |
| JP | 2710152 | 10/1997 |
| JP | 2005-133168 | 5/2005 |
| JP | 4044591 | 11/2007 |
| JP | 2009-32880 | 2/2009 |
| WO | 2006/035911 | 4/2006 |
| WO | 2008/032503 | 3/2008 |
| WO | 2009/013979 A1 | 1/2009 |
| WO | 2009/028486 A1 | 3/2009 |

OTHER PUBLICATIONS

Office Action dated Dec. 21, 2011 in Korean Patent Application No. 10-2010-16156 (with English translation).

* cited by examiner

*Primary Examiner* — Mandy C Louie

(74) *Attorney, Agent, or Firm* — Oblon, McClelland, Maier & Neustadt, L.L.P.

(57) ABSTRACT

An iron-based soft magnetic powder for dust core having a high magnetic flux density, maintaining high electric insulation even after annealing, and more excellent in the mechanical strength in which a coating film having a phosphate conversion coating film is formed on the surface thereof and the peak height for the absorption of hydroxyl groups formed at 3700 $cm^{-1}$ to 2500 $cm^{-1}$ is 0.04 or more being indicated by absorbance when the coating film is analyzed by infrared diffuse reflectance spectroscopy.

15 Claims, No Drawings

IRON-BASED SOFT MAGNETIC POWDER FOR DUST CORE, METHOD FOR MANUFACTURING THE SAME, AND DUST CORE

CROSS-REFERENCE TO RELATED APPLICATIONS

The present application is a divisional of U.S. application Ser. No. 12/648,684, filed on Dec. 29, 2009, which claims priority to Japanese patent application JP 2009-041090, filed on Feb. 24, 2009. The entire contents of each of the above are incorporated herein by reference.

BACKGROUND OF THE INVENTION

Field of the Invention

The present invention concerns an iron-based soft magnetic powder for dust core, a method of manufacturing the same, and a dust core obtained by using the iron-based soft magnetic powder.

Description of the Related Art

A magnetic core used in alternating magnetic fields is required to have less iron core low and high magnetic flux density. Further, it is also required to have favorable handlability in the manufacturing step and a sufficient mechanical strength not to be fractured during winding for making coils. In view of the foregoings, a technique of coating iron powder particles with electrically insulating resins has been known in the field of the dust core. In the dust core obtained by using the iron powder particles coated with the electrically insulating resin, eddy current loss is suppressed to decrease the iron core loss, and iron powder particles are adhered to each other by the resin to improve the mechanical strength as well.

On the other hand, since it is effective to form the dust core at a high density for improving the magnetic flux density, it is preferred to decrease the amount of the electrically insulating resin for coating the iron powder particles. Particularly for reducing the hysteresis loss to decrease the iron core loss, it is considered to be effective to release the strain of the dust core by annealing at a high temperature. Then, it has been demanded for the development of an iron powder for dust core capable of efficiently insulating the iron powder particles to each other even with a small content of the electrically insulating resin and capable of maintaining good electric resistance even when subjected to a heat treatment at a high temperature such as annealing.

With the view point described above, a technique of using a highly heat resistant silicone resin has been developed as the electrically insulating resin. Further, for the insulating materials other than the resin, a technique of utilizing a film of a glassy compound obtained from phosphoric acid, etc. as the insulation layer has already been known long since (Japanese Patent No. 2710152: Patent Document 1).

By the way, when compared with a silicone resin which is an organic high molecular material, it has been considered that inorganic insulation films described above are naturally excellent in the thermal stability, but they involve a problem that the insulation is lowered when heat treatment at a high temperature (annealing) is performed.

Then, the present applicant has made a study for solving the problem described above and succeeded in providing a dust core having high magnetic flux density, low iron core loss, and high mechanical strength by forming a phosphate conversion coating film containing specific elements and a silicone resin coating film in this order on the surface of an iron-based soft magnetic powder, which has already been granted (Japanese Patent No. 4044591: Patent Document 2).

However, the requirement for improving the performance of the dust core has been increased further compared with that at the time of filing the Patent Document 2 and high magnetic flux density, low iron core loss, and high mechanical strength have now been demanded more than ever before. Among all, the demand for the mechanical strength is high and it has been demanded for a dust core with improved mechanical strength while maintaining high magnetic flux density and low iron core loss.

SUMMARY OF THE INVENTION

The present invention has been achieved for solving the problem described above and it intends to provide an iron-based soft magnetic powder for a dust core having a high magnetic flux density, maintaining high electric insulation even after annealing, and more excellent in the mechanical strength.

In an iron-based soft magnetic powder for dust core according to the invention capable of solving the foregoing problem, a coating film having a phosphate conversion coating film is formed on the surface of the iron-based soft magnetic powder and the peak height for the absorption of hydroxyl groups formed at 3700 $cm^{-1}$ to 2500 $cm^{-1}$ is 0.04 or more being indicated by absorbance when the coating film is analyzed by infrared diffuse reflectance spectroscopy.

As described above, since the coating film having the phosphate conversion coating film formed on the surface of the iron-based soft magnetic powder has hydroxyl groups by a predetermined amount or more, the phosphate conversion coating film forms a strong bond with the surface of the iron-based soft magnetic powder by way of oxygen derived from the hydroxyl group. It is considered that bonding force between iron-based soft magnetic powders to each other is improved and the mechanical strength of the dust core obtained by using the iron-based soft magnetic powder of the invention is also improved as a result.

In a preferred embodiment of the iron-based soft magnetic powder for dust core of the invention, the coating film further has a silicone resin coating film on the phosphate conversion coating film.

The measuring conditions upon analyzing the coating film by the infrared diffuse reflectance spectroscopy are to be described below.

The invention includes a dust core obtained by powder compaction of an iron-based soft magnetic powder for dust core and applying a heat treatment at 400° C. or higher. In this case, the density of the dust core is preferably 7.55 $g/cm^3$ or more.

The invention includes a method of manufacturing an iron-based soft magnetic powder for dust core of mixing an iron-based magnetic powder having a non-hydrated phosphate conversion coating film formed on the surface thereof and water to form a phosphate conversion coating film.

In the present specification, when "non-hydrated phosphate conversion coating film" is referred to as described above this means a phosphate conversion coating film before introduction of hydroxyl groups by a predetermined amount.

Further, in a preferred embodiment, a silicone resin coating film is formed on the phosphate conversion coating film by mixing an iron-based soft magnetic powder with a silicone resin solution formed by dissolving a silicone resin in water and/or organic solvent. Then, it is also a preferred embodiment in which the iron-based soft magnetic powder for dust core formed with the silicone resin coating film is heated to thereby harden the silicone resin coating film previously.

The iron-based soft magnetic powder formed with the non-hydrated phosphate conversion coating film on the surface thereof used in the manufacturing method described above may also be obtained by mixing a solution formed by dissolving a P-containing compound into a solvent comprising water and/or an organic solvent and an iron-based soft magnetic powder.

According to the invention, a dust core further excellent not only in the high magnetic flux density and the low iron core loss but also in mechanical strength can be obtained.

DETAILED DESCRIPTION OF THE PREFERRED EMBODIMENTS

[Iron-Based Soft Magnetic Powder for Dust Core]

In the iron-based soft magnetic powder for dust core according to the present invention (hereinafter sometimes referred to simply as "iron powder for dust core"), a coating film having a phosphate conversion coating film is formed on the surface of the iron-based soft magnetic powder (hereinafter sometimes referred to simply as "soft magnetic powder"), and the peak height for the absorption of hydroxyl groups formed at 3700 $cm^{-1}$ to 2500 $cm^{-1}$ is 0.04 or more being indicated by absorbance when the coating film is analyzed by infrared diffuse reflectance spectroscopy. The iron-based soft magnetic powder for dust core of the invention is to be described specifically.

(Iron-Based Soft Magnetic Powder)

The soft magnetic powder used in the invention is an iron-based powder comprising a ferromagnetic material and it specifically includes a pure iron powder, an iron-based alloy powder (Fe—Al alloy, Fe—Si alloy, a sendust, permalloy), and an iron-based amorphous powder. The soft magnetic powders can be manufactured, for example, by forming molten iron (or molten iron alloy) into fine particles by an atomizing method, and subsequently reducing and then pulverizing the same. According to such a manufacturing method, a soft magnetic powder having a particle size of 20 to 250 μm for 50% cumulative particle size frequency distribution in a particle size distribution evaluated by a sieving method (median diameter) is obtained and the particle size of the soft magnetic powder used in the invention is preferably about 50 to 150 μm (median diameter).

(Phosphate Conversion Coating Film)

In the iron powder for dust core of the invention, a coating film having a phosphate conversion coating film is formed on the surface of the soft magnetic powder. More specifically, a phosphate conversion coating film is formed on the surface of the soft magnetic powder. This can provide the soft magnetic powder with electric insulation.

The composition of the phosphate conversion coating film is not particularly restricted so long as this is a glassy coating film formed by using a P-containing compound, and it is preferably a glassy coating film formed by using a compound containing Co, Na and S together with Cs and/or Al, in addition to P. The iron powder for dust core of the invention has a feature in having hydroxyl groups by a predetermined amount or more in the coating film, because this is effective for suppressing the lowering of the specific resistivity when oxygen derived from the hydroxyl group forms a semiconductor with Fe upon subsequent heat treatment (annealing).

In a case where the phosphate conversion coating film is a glassy layer formed by using the compound containing Co or the like described above other than P, contents of such elements are preferably from 0.005 to 1 mass of P, 0.005 to 0.1 mass % of Co, 0.002 to 0.6 mass % of Na, and 0.001 to 0.2 mass of S as the amounts based on 100 mass % of the iron powder for dust core. Further it is preferred that Cs is from 0.002 to 0.6 mass %, and Al is from 0.001 to 0.1 mass %. When Cs and Al are used together, it is also preferred that each of them is within the range described above.

Among the elements described above, P forms a chemical bond with the surface of the soft magnetic powder by way of oxygen. Accordingly, when the amount of P is less than 0.005 mass %, the amount of chemical bonds between the surface of the soft magnetic powder and the phosphate conversion coating film becomes insufficient, thereby possibly failing to form a strong film, which is not preferred. On the other hand, when the amount of P exceeds 1 mass %, this is not preferred since P not having concerned with the chemical bond remains unreacted as it is to rather lower the bonding strength.

Co, Na, S, Cs, and Al have a function of hindering the formation of a semiconductor by Fe and oxygen, thereby suppressing the lowering of the specific resistivity during subsequent heat treatment (annealing). The effect of Co, Na, and S is optimized by composite addition. Further, while one of Cs and Al may be used, the lower limit value for each of the elements is a minimum amount for providing the effect of the composite addition of Co, Na, and S. Further, when the addition amount of Co, Na, S, Cs, and Al is increased unnecessarily, it is considered that relative balance cannot be maintained upon composite addition, as well as formation of the chemical bond between P and the surface of the soft magnetic powder by way of oxygen may be hindered.

In the phosphate conversion coating film of the invention, Mg and B may be contained. The content of the elements is preferably from 0.001 to 0.5 mass % both for Mg and B as the amount based on 100 mass % of the iron powder for dust core.

The thickness of the phosphate conversion coating film of the invention is preferably about 1 to 250 nm. When the thickness is less than 1 nm, the insulation effect may not be developed sometimes. On the other hand, when it exceeds 250 nm, the insulation effect is saturated and it is not desired also for increasing the density of the dust core. More preferred thickness is from 10 to 50 nm.

(Amount of Hydroxyl Group)

The feature of the coating film of the invention is to contain hydroxyl groups, and the amount of the hydroxyl groups is represented by the peak height of 0.04 or more, preferably, 0.042 or more, more preferably, 0.045 or more and, further preferably, 0.050 or more when determined by the method described below. In the most preferred embodiment, the phosphate conversion coating film shows the amount of the hydroxyl groups described above. Since the phosphate conversion coating film forms the strong bond with the surface of the soft magnetic powder by way of oxygen when the film formed on the surface of the soft magnetic powder contains the hydroxyl groups by the amount of 0.04 or more as the peak height as described above, bonding force between the iron-based soft magnetic powders is also improved as a result, and the mechanical strength of the obtained dust core can be improved. On the other hand, in a case where the amount of the hydroxyl groups represented by the peak height is less than 0.04, the phosphate conversion coating film cannot form a strong bond with the surface of the soft magnetic powder by way of oxygen and the mechanical strength of the obtained dust core cannot be improved. While the upper limit for the amount of the hydroxyl groups is not particularly restricted, it may sometimes result in a technical difficulty for forming a film (particularly, phosphate conversion coating film) having the peak height exceeding 0.1.

(Method of Measuring the Amount of Hydroxyl Group)

Apparatus: Magna-750 Ft-IR spectrometer, manufactured by Nicolet,

Attachment: Diffuse reflectance attachment, manufactured by

Spectra-Tech (blocker is used upon measurement)

Detector: DTGS

Measuring region: 4000 to 400 $cm^{-1}$

Resolution: 8 $cm^{-1}$

Number of accumulation: 1000 times

Data processing: sampled spectra are indicated by absorbance. Baseline correction is performed so as not to contain absorption of hydroxyl groups (at about 3700 $cm^{-1}$ to 2500 $cm^{-1}$), and the peak height for the hydroxyl groups is measured from the base line.

(Silicone Resin Coating Film)

In the iron powder for dust core of the invention, it is preferred that the coating film has a silicone resin coating film further on the phosphate conversion coating film. Since powders are bonded strongly to each other upon completion of the crosslinking/hardening reaction of the silicone resin (upon powder compaction), the mechanical strength of the obtained dust core is increased. Further, Si—O bonds of excellent heat resistance are formed to provide an insulation coating film of excellent thermal stability.

The silicone resin coating film preferably has more trifuncitonal T units ($RsiX_3$: X is hydrolysable group) than the two functional D units ($R_2SiX_2$: X has the same meanings as described above). This is because the powder becomes sticky when the hardening is slow, to worsen the handlability after forming the silicone resin coating film. However, when many tetrafunctional Q units ($SiX_4$: X has the same meanings as described above) are contained, powders are strongly bonded to each other upon preliminary hardening (to be described later) thereby making the subsequent powder compaction impossible, which is not preferred. Accordingly, the silicone resin coating film preferably contains 60 mol % or more of the T units and, more preferably, contains 80 mol % or more of the T units and, most preferably, the coating film consists entirely of the T units.

R described above includes a methyl group and a phenyl group. While it is generally considered that the heat resistance is higher as the coating film contains more phenyl groups, presence of the phenyl group cannot be said so effective under the annealing condition at a high temperature as adopted in the invention. It may be considered that the bulkiness of the phenyl group disturbs the dense glassy network structure to rather decrease the thermal stability or the effect of hindering the formation of a compound with iron. Accordingly, in the silicone resin coating film of the invention, it is preferred that the methyl groups are present by 50 mol % or more and, more preferably, 70 mol % or more and, most preferably, phenyl groups are not present at all.

The ratio of methyl group to phenyl group and the functionality of the silicone resin coating film can be analyzed by FT-IR, etc.

The deposition amount of the silicone resin coating film is preferably adjusted so as to be 0.05 to 0.3 mass based on 100 mass % of the iron powder for dust core in which the phosphate conversion coating film and the silicon resin coating film are formed in this order. When the deposition amount is less than 0.05 mass %, the iron powder for dust core formed with the silicone resin coating film is poor in the insulation to lower the electric resistance. Further, when the deposition amount exceeds 0.3 mass %, increase of the density can be hardly attained for the obtained dust core.

The thickness of the silicone resin coating film is preferably 1 to 200 nm and a more preferred thickness is 20 to 150 nm. Further, the total thickness for the phosphate conversion coating film and the silicone resin coating film is preferably 250 nm or less. When it exceeds 250 nm, the magnetic flux density sometimes lowers greatly.

(Lubricant)

The iron powder for dust core of the invention may further contain a lubricant. By the effect of the lubricant, friction resistance can be decreased between the iron powders for dust core to each other, or between the iron powder for dust core and the inner wall of a molding die upon powder compaction of the iron powder for dust core thereby capable of preventing die-galling of the molded product or heat generation during molding. For providing such an effect effectively, it is preferred that the lubricant is contained by 0.2 mass % or more based on the entire amount of the iron powder for dust core. However, since increase for the amount of the lubricant is contrary to the increase of the density of the powder compact, it is preferred that the amount is kept to 0.8 mass % or less.

The method of incorporating the lubricant in the iron powder for dust core is not particularly restricted and, for example, it includes a method of adding a lubricant to an iron powder for dust core, and a method of previously coating a lubricant to the inner wall surface of a molding die upon powder compaction of the iron powder for dust core, followed by molding (die-wall lubrication molding). In the case of the die-wall lubrication molding, the amount of the lubricant may be less than 0.2 mass %.

For the lubricant, those known so far may be used and include, specifically, powders of metal salts of stearic acid such as zinc stearate, lithium stearate, and calcium stearate, as well as paraffin, wax, natural or synthesis resin derivatives.

[Method of Manufacturing Iron-Based Magnetic Powder for Dust Core]

While the iron powder for dust core of the invention may be manufactured by any method, for the sake of convenience, the phosphate conversion coating film is preferably formed to the surface of the soft magnetic powder, by mixing a soft magnetic powder formed at the surface thereof with a non-hydrated phosphate conversion coating film (hereinafter sometimes referred to simply as: "phosphate conversion coating film forming powder") with water, thereby hydrating the same (referred to as a phosphate conversion coating film). This can easily increase the amount of the hydroxyl groups of the coating film (particularly, phosphate conversion coating film) to a predetermined amount. The method of manufacturing the iron-based soft magnetic powder for dust core of the invention is to be described specifically below.

(Method of Manufacturing a Soft Magnetic Powder Formed with a Non-Hydrated Phosphate Conversion Coating Film at the Surface)

The phosphate conversion coating film forming powder used in the manufacturing method of the invention may be manufactured by any manner and, for example, it can be obtained by mixing a solution in which a P-containing compound is dissolved in a solvent comprising water and/or an organic solvent and a soft magnetic powder, and then optionally evaporating the solvent.

The solvent used in this step includes water, a hydrophilic organic solvent such as an alcohol or a ketone, and a mixture thereof. Known surfactant may be added in the solvent.

The P-containing compound includes, for example, orthophosphoric acid ($H_3PO_4$). Further, the compound for forming the phosphate conversion coating film having the composition described above includes, for example, $Co_3(PO_4)_2$ (Co and P sources), $Co_3(PO_4)_2.8H_2O$ (Co and P sources), $Na_2HPO_4$ (P and Na sources), $NaH_2PO_4$ (P and Na sources), $NaH_2PO_4.nH_2O$ (P and Na sources), Al $(H_2PO_4)_3$ (P and Al sources), $Cs_2SO_4$ (Cs and S sources), $H_2SO_4$ (S source), MgO (Mg source), and $H_3BO_3$ (B source). Among them, use of dihydrogen sodium phosphate salt ($NaH_2PO_4$) as the P source and the Na source is preferred since the density, the mechanical strength, and the specific resistivity of the obtained dust core are well-balanced and become excellent.

The addition amount of the P-containing compound based on the soft magnetic powder may be any amount so long as this provides the composition of the formed phosphate conversion coating film within the range described above. For example, the composition of the formed phosphate conversion coating film can be within the range described above by adding about 1 to 10 mass parts, based on 100 mass parts of the soft magnetic powder, of a solution formed by dissolving the P-containing compound (further, a compound containing elements to be incorporated in the coating film) prepared such that the solid content is about from 0.01 to 10 mass.%, and mixing them by a known mixing machine such as a mixer, a ball mill, a kneader, a V-type blender, or a pelleting machine.

Further, if necessary, the mixed product is dried at 150 to 250° C. in an atmospheric air under a reduced pressure or in vacuum after the mixing step.

After drying, it is preferred to pass the dried product through a sieve with an opening of about 200 to 500 μm.

(Introduction of Hydroxyl Groups)

The mixing amount of water is, preferably, 0.8 mass parts or more, more preferably, 1 mass part or more and, further preferably, 1.5 mass parts or more based on 100 mass parts of the phosphate conversion coating film forming powder. When the mixing amount of water is less than 0.8 mass parts, the amount of the hydroxyl groups of the coating film (particularly, phosphate conversion coating film) cannot sometimes be increased to 0.04 or more by the peak height. While the upper limit for the mixing amount of water is not particularly restricted, it is preferably 40 mass parts or less, preferably, 20 mass parts or less and, further preferably, 18 mass parts or less. When it exceeds 40 mass parts, drying for the obtained iron powder for dust core (removal of the water content to be described later) may sometimes take much time. Further, when the iron powder for dust core after drying is passed through a sieve optionally, the powder does not sometimes pass through the sieve.

The time for mixing the phosphate conversion coating film forming powder and water is not particularly restricted and it may be, for example, from 3 minutes to 10 minutes. Further, water may be heated optionally (30° C. to 100° C.).

In the manufacturing method of the invention, a heat treatment is preferably applied after hydration by mixing with water thereby removing the content of water other than that for the hydration ingredient. The conditions for the heat treatment are not particularly restricted so long as the purpose can be obtained and, for example, the heat treatment may be applied, for example, at 50 to 100° C., for about 15 minutes to one hour.

(Formation of Phosphate Conversion Coating Film to the Surface of Soft Magnetic Powder)

The phosphate conversion coating film may be formed on the surface of the soft magnetic powder in the invention by a method of mixing the phosphate conversion coating film forming powder with water thereby hydrating the powder and, for example, also by a method of manufacturing the phosphate conversion coating film forming powder described above by using water as a solvent, and conducting the subsequent drying operation under the conditions restricted, for example, at 50 to 100° C. for about 15 minutes to one hour without by way of the mixing operation with water (hydration operation), thereby forming a phosphate conversion coating film having the amount of hydroxyl groups represented as 0.04 or more by the peak height.

(Formation of Silicone Resin Coating Film)

In the iron powder for dust core of the invention, a silicone resin coating film is preferably formed further over the phosphate conversion coating film. The silicone resin coating film can be formed, for example, by mixing the iron powder for dust core obtained by a hydrating treatment and a subsequent heat treatment (hereinafter sometimes simply referred to as "hydration product" for the sake of convenience) and a silicone resin solution in which a silicone resin is dissolved in water and/or organic solvent, and then optionally evaporating the water and/or the organic solvent.

In a case of using water as the solvent for dissolving the silicone resin, hydroxyl groups can also be introduced into the phosphate conversion coating film simultaneously with the formation of the silicone resin coating film. Accordingly, so long as the amount of the hydroxyl groups in the coating film after forming the silicone resin coating film can exhibit 0.04 or more by the peak height, formation of the silicone resin coating film may also be conducted by using an iron powder for dust core in which a phosphate conversion coating film having hydroxyl groups with a peak height of less than 0.04 is formed on the surface thereof.

The silicone resin used in this step is preferably a resin that can provide the composition (particularly, T unit and R) of the silicone resin coating film formed by using the same within the range described above, and it is preferred to use a silicone resin having the T unit of preferably 60 mol % or more (more preferably, 80 mol % or more, most preferably, 100 mol %) and having methyl group in R of 50 mol % or more (more preferably, 70 mol % or more and, most preferably, 100 mol %). Specifically, it is preferred to use a methyl phenyl silicone resin having 50 mol % or more of methyl groups (for example, KR 255 and KR 311, manufactured by Shin-Etsu Chemical Industry Co.) and it is more preferred to use a methyl phenyl silicone resin having 70 mol % or more of methyl groups (for example, KR 300, manufactured by Shin-Etsu Chemical Industry Co.), and it is most preferred to use a methyl silicone resin having no phenyl groups at all (for example, KR 251, KR 400, KR 220L, KR 242A, KR 240, KR 500, and KC89, manufactured by Shin-Etsu Chemical Industry Co., or SR 2400, manufactured by Dow Corning Toray Co., Ltd.).

The organic solvent used in this step includes, for example, alcohols, and petroleum type organic solvents such as toluene and xylene.

The addition amount of the silicone resin to the hydration product may be such that the deposition amount of the silicone resin coating film to be formed is within the range as described above. The deposition amount of the silicone resin coating film can be made within the range described above, for example, by adding about 0.5 to 10 mass parts of the silicone resin solution adjusted to a solid content of about 2 to 10 mass % to 100 parts of the hydration product. When the addition amount is less than 0.5 mass parts, it may take much time for mixing, or may possibly make the coating film not uniform. On the other hand, when it exceeds 10 mass parts, it may take much time for drying or may possibly render the drying insufficient. The silicone resin solution may be properly heated previously.

A mixing device used upon mixing the hydration product and the silicone resin solution in this step is not particularly restricted and the mixing apparatus described previously may be used.

In this step, after the mixing operation for the hydration product and the silicone resin solution, the water and/or the organic solvent may be evaporated optionally by drying.

In the drying step, it is preferred to evaporate and release the water and/or the organic solvent sufficiently by heating to a temperature at which the organic solvent used is evaporated and to a temperature lower than the hardening temperature of the silicone resin. A specific drying temperature is preferably about 60 to 80° C. in a case of using the alcohols or the petroleum organic solvents described above as the organic solvent.

After the drying, the dried product is preferably passed through a sieve with an opening of about 200 to 500 μm for removing aggregated undissolved lumps.

After the drying, it is recommended to heat the iron-based soft magnetic powder for dust core formed with the silicone resin coating film (hereinafter sometimes referred to simply as "silicone resin coating film-formed powder" for the sake of convenience, thereby preliminarily hardening the silicone resin coating film.

The preliminary hardening is a treatment of completing the hardening process during hardening of the silicone resin coating film in a powdery state. The preliminary hardening treatment can ensure the flowability of the preliminary hardened product of the silicone resin coating film-formed powder during warm compaction (about 100 to 250° C.). As a specific method, a method of heating the silicone resin coating film-formed powder near the hardening temperature of the silicone resin for a short time is simple and convenient, but a method of using a chemical (hardener) may also be utilized. The preliminary hardening and hardening (not preliminary but complete hardening) are different in that powders are not completely adhered and solidified to each other but easily crushed in the preliminary hardening treatment, whereas the resin is hardened and the powders are adhered and solidified to each other in the hardening treatment under heating at high temperature which is conducted after the powder compaction. The strength of the powder compact is improved by the complete hardening treatment.

As described above, by preliminarily hardening the silicone resin coating film-formed powder and then pulverizing the same, an iron powder for dust core of excellent flowability is obtained, and the powder can be charged into a molding die smoothly like sand upon powder compaction. For example, without preliminary hardening, powders are adhered to each other during warm compaction thereby sometimes making it difficult to charge the power into the molding die in a short time. In view of practical operation, improvement in the handlability is extremely useful. Further, it has been found that the specific resistivity of the obtained dust core is improved extremely by the preliminary hardening. Although the reason is not apparent, it may be considered that close adhesion with the soft magnetic powder is improved upon hardening.

In a case of performing the preliminary hardening by a short time heating method, the heat treatment may be preferably performed at 100 to 200° C. for 5 to 100 minutes. A heat treatment at 130 to 170° C. for 10 to 40 minutes is more preferred. Also after the preliminary hardening, the powder is preferably passed through a sieve.

[Dust Core]

The invention includes a dust core obtained by using the iron-based soft magnetic powder for dust core (iron powder for dust core). The dust core of the invention is to be described specifically.

When the dust core is manufactured, the iron powder for dust core is at first molded by powder compaction. The powder compaction method is not particularly restricted and methods known so far can be adopted.

A preferred condition for powder compaction is 490 MPa to 1960 MPa and, more preferably, 790 MPa to 1180 MPa of the surface pressure. It is particularly preferred to perform powder compaction under the condition at 980 MPa or more since a dust core with the density of 7.55 g/cm$^3$ or more can be obtained easily and a dust core having high strength and good magnetic property (magnetic flux density) can be obtained. In term of the molding temperature, either the room temperature compaction or warm compaction (100 to 250° C.) is possible. Warm compaction by die-wall lubrication is preferred since a dust core of higher strength can be obtained. As a measure of the strength, 120 MPa or more is preferred for the measuring method in the example to be described later.

After the powder compaction, annealing is performed at a high temperature for decreasing the hysteresis loss of the dust core. The annealing temperature in this case is preferably 400° C. or higher and it is desirable to apply a heat treatment at a higher temperature providing that the specific resistivity is not deteriorated. While the atmosphere during annealing is not particularly restricted, an atmosphere of an inert gas such as nitrogen is preferred. The annealing time is not particularly restricted so long as the specific resistivity is not deteriorated and it is preferably 20 minutes or more, more preferably, 30 minutes or more and, further preferably, one hour or more.

In addition, the invention can be practiced in various embodiments by applying improvements, modifications, and changes based on the knowledge of persons skilled in the art within a range not departing from the sprit thereof.

EXAMPLE

The present invention is to be described specifically with reference to examples. However, the invention is not restricted by the following examples but practicing of the invention under modifications within a range not departing from the spirit described above and to be described later are included in the technical range of the invention. Unless otherwise specified, "part" means "mass part" and "%" means "mass %", respectively.

At first, evaluation methods used in the examples and the comparative examples are to be described below.

(Amount of Hydroxyl Groups)

Apparatus: Magna-750 FT-IR spectrometer, manufactured by Nicolet

Attachment: Diffuse reflectance attachment, manufactured by Spectra-Tech (blocker is used upon measurement)

Detector: DTGS

Measuring range: 4000 to 400 cm$^{-1}$

Resolution power: 8 cm$^{-1}$

Number of accumulation: 1000 times

Data processing: Sampled spectrum is displayed by absorbance. Base line correction is conducted so as not to contain absorption of hydroxyl groups (at about 3700 $cm^{-1}$ to 2500 $cm^{-1}$), and peak height of the hydroxyl groups from the base line is measured.

(Density)

Density was calculated based on the volume and the mass of the test specimen.

(Magnetic Permeability)

A ring-like test specimen of 36 mm outer diameter×24 mm inner diameter×5 mm thickness was prepared and the permeability was measured by a BH analyzer.

(Specific Resistivity)

A rectangular test specimen of 31.75 mm×12.7 mm×5 mm thickness was prepared and the specific resistivity was measured by a 4-terminal method (inter-terminal distance: 7 mm)

(Bending Strength)

A rectangular test specimen of 31.75 mm×12.7 mm×5 mm thickness was prepared, and the bending strength was determined by a three-point bending test according to JPMA M 09-1992 of Japan Powder Metallurgy Association.

Example 1

(Preparation of Phosphate Conversion Coating Film-Formed Powder)

A pure magnetic powder ATOMEL 300 NH; particle diameter (median diameter) of 80 to 100 μm (manufactured by Kobe Steel Ltd.) was used as the soft magnetic powder. 1000 parts of water, 88.5 parts of $Na_2HPO_4$, 181 parts of $H_3PO_4$, 61 parts of $H_2SO_4$, 30 parts of $Co_3(PO_4)_2$, and 44 parts of $Cs_2SO_4$ were mixed, 10 parts of a treating solution diluted by ten times was added further to 200 parts of the pure iron powder described above which was passed through a sieve of 300 μm opening. After mixing them for 30 minutes or more by using a V-type blender, they were dried in atmospheric air at 200° C. for 30 minutes and then passed through a sieve of 300 μm opening.

(Introduction of Hydroxyl Groups)

Water was added by 15 g to 800 g of the phosphate conversion coating film-formed powder obtained in the step described above and they were mixed for 5 minutes while stirring. Then, a heat treatment was applied at 75° C. for 30 minutes, the water content other than the hydration component was removed to obtain an iron-based soft magnetic powder for dust core.

(Measurement for the Amount of Hydroxyl Groups)

For the obtained iron-based soft magnetic powder for dust core, the amount of hydroxyl groups in the phosphate conversion coating film was measured. The obtained result is shown in Table 1.

(Dust Core Compaction Molding)

Successively, a solution of a lubricant formed by dispersing Zn stearate in an alcohol was coated on the surface of a molding die and then an iron-based soft magnetic powder for dust core was placed and dust core compaction was performed under a surface pressure of 980 MPa at a room temperature of 25° C. The size of the compaction product was 31.75 mm×12.7 mm×about 5 mm height. Then, the compaction product was annealed in a nitrogen atmosphere at 600° C. for one hour to obtain a dust core of the invention. The temperature elevation rate was set at about 5° C./min, and furnace cooling was conducted after the heat treatment.

(Dust Core Characteristic)

Density, permeability, specific resistivity, and bending strength of the obtained dust core were measured. The result is shown in Table 1.

TABLE 1

| | Water addition amount (g) | Amount of hydroxyl groups | Density (g/$cm^3$) | Permeability | Specific resistivity (μΩ · m) | Bending strength (MPa) |
|---|---|---|---|---|---|---|
| Example 1 | 15 | 0.040 | 7.55 | 525 | 14.6 | 133.55 |
| Example 2 | 40 | 0.046 | 7.56 | 531 | 17.1 | 141.91 |
| Example 3 | 120 | 0.052 | 7.55 | 525 | 18.4 | 146.29 |
| Comparative example 1 | — | 0.019 | 7.56 | 531 | 12.1 | 119.38 |

Examples 2 and 3, Comparative Example 1

Iron-based soft magnetic powders for dust core and dust cores were manufactured respectively in the same manner as in Example 1 except for changing the amount of water added upon introduction of hydroxyl groups as shown in Table 1, and the amount of hydroxyl groups for each of the iron-based soft magnetic powders for dust core, and the density, the permeability, the specific resistivity, and the bending strength for each of the dust cores were measured. The result is shown in Table 1.

Example 4

(Preparation of Preliminary Hardened Product of Silicone Resin Coating Film-Formed Powder)

Silicone resin (KR 220L; 100 mol % of methyl group, 100 mol % of T units: manufactured by Shin-Etsu Chemical Co., Ltd.) was dissolved in toluene to prepare a resin solution at a solid concentration of 4.8%. The resin solution was added and mixed to the iron-based soft magnetic powder for dust cores (800 g) prepared in Example 1 such that the resin solid content was 0.15%. Then, they were heated and dried in an oven furnace under an atmospheric pressure at 75° C. for 30 minutes and then passed through a sieve of 300 μm opening. Then, preliminary heating was conducted at 150° C. for 30 minutes to obtain a preliminary hardened product of the silicone resin coating film-formed powder.

(Measurement for the Amount of Hydroxyl Groups)

For the obtained iron-based soft magnetic powder for dust core, the amount of hydroxyl groups of the coating film of the phosphate conversion coating film and the silicone resin coating film was measured. The obtained result is shown in Table 2.

(Dust Core Compaction)

Successively, a solution of a lubricant formed by dispersing Zn stearate in an alcohol was coated on the surface of a die and then an iron-based soft magnetic powder for dust core was placed and dust core powder compaction was performed under a surface pressure of 980 MPa at a room temperature of 25° C. The size of the compaction product was 31.75 mm×12.7 mm×about 5 mm height. Then, the compaction product was annealed in a nitrogen atmosphere at 600° C. for one hour to obtain a dust core of the invention. The temperature elevation rate was set at about 5° C./min, and furnace cooling was conducted after the heat treatment.

(Dust Core Characteristic)

Density, permeability, specific resistivity, and bending strength of the obtained dust core were measured. The result is shown in Table 2.

Examples 5 and 6 and Comparative Example 2

Preliminary hardened products of the silicone resin coating film-formed powder were obtained in the same manner as in Example 4 except for using the iron-based soft magnetic powders for dust core prepared in Examples 2 and 3 and Comparative Example 1 respectively instead of the iron-based soft magnetic powder for dust core prepared in Example 1 in the preparation of the preliminary hardened product of the silicone resin coating film-formed powder in Example 4, and then dust cores were manufactured. The amount of hydroxyl groups in each of the obtained iron-based soft magnetic powders for dust core, and the density, the permeability, the specific resistivity, and the bending strength for each of the dust cores were measured respectively.

The result is shown in Table 2.

TABLE 2

| | Amount of hydroxyl groups | Density ($g/cm^3$) | Permeability | Specific resistivity ($\mu\Omega \cdot m$) | Bending strength (MPa) |
|---|---|---|---|---|---|
| Example 4 | 0.040 | 7.57 | 535 | 111.8 | 121.42 |
| Example 5 | 0.046 | 7.58 | 545 | 115.6 | 125.77 |
| Example 6 | 0.052 | 7.57 | 535 | 118.4 | 131.63 |
| Comparative example 2 | 0.019 | 7.58 | 541 | 103.5 | 106.65 |

Reference Examples 1 and 2

Dust core powder compaction was performed to manufacture dust cores in the same manner as in Examples 5 and 6 except for performing dust core compaction at a surface pressure of 784 MPa and at a room temperature of (25° C.) in the dust core molding in Examples 5 and 6. The density, the permeability, the specific resistivity, and the bending strength of the obtained dust cores were measured. The result is shown in Table 3.

TABLE 3

| | Amount of hydroxyl groups | Density ($g/cm^3$) | Permeability | Specific resistivity ($\mu\Omega \cdot m$) | Bending strength (MPa) |
|---|---|---|---|---|---|
| Reference example 1 | 0.046 | 7.48 | 506 | 150.9 | 115.41 |
| Reference example 2 | 0.052 | 7.47 | 497 | 130.3 | 118.33 |

By comparison between Examples 1 to 6 and Comparative Examples 1 to 2, it has been found that the specific resistivity is improved by introducing hydroxyl groups to the phosphate conversion coating film (that is, dust core of low iron core loss is obtained). Further, it was found that also the bending strength was improved (that is dust cores also excellent in the mechanical strength could be obtained). Further, in view of Examples 1 to 3 and Examples 4 to 6, it has been found that the dust core shows higher specific resistivity (dust core of lower iron core loss could be obtained) when the silicone resin coating film is formed.

Further, in view of Examples 5 and 6 and Reference Examples 1 and 2, it has been found that increase of the density of the dust core to 7.55 $g/cm^3$ or more is preferred since the permeability and the bending strength are improved.

The iron-based soft magnetic powder for dust core of the invention is useful in the manufacture of the dust core as rotors for motors or cores for stators.

What is claimed is:

1. A method of manufacturing a coated iron-based soft magnetic powder, comprising applying water to a surface of a non-hydrated phosphate conversion coating film coated on an iron-based soft magnetic powder, to obtain a coated iron-based soft magnetic powder wherein a peak height for the absorption of hydroxyl groups formed at 3700 $cm^{-1}$ to 2500 $cm^{-1}$ is 0.04 or more as indicated by absorbance when the coating film is analyzed by infrared diffuse reflectance spectroscopy.

2. The method of claim 1, further comprising contacting the coated iron-based soft magnetic powder obtained in claim 1 with a silicone resin solution comprising a silicone resin dissolved in water and/or an organic solvent, to obtain a silicone resin-coated iron-based soft magnetic powder.

3. The method of claim 2, further comprising heating the silicone resin-coated iron-based soft magnetic powder, thereby hardening the silicone resin coating.

4. The method of claim 1, wherein the non-hydrated phosphate conversion coating film coated on the iron-based soft magnetic powder is obtained by mixing (i) a solution comprising a P-containing compound dissolved in a solvent comprising water and/or an organic solvent with (ii) an iron-based soft magnetic powder.

5. The method of claim 1, further comprising powder-compacting the coated iron-based soft magnetic powder to obtain a compacted powder, and heat treating the compacted powder at a temperature of 400° C. or higher, to obtain a dust core.

6. The method of claim 1, wherein the obtained dust core has a density of 7.55 $g/cm^3$ or more.

7. The method of claim 1, wherein the water is applied to the surface of the non-hydrated phosphate conversion coating film in an amount of 0.8 to 40 parts by mass of water based on 100 parts by mass of the iron-based soft magnetic powder coated with the non-hydrated phosphate conversion coating film.

8. The method of claim 1, wherein the non-hydrated phosphate conversion coating film comprises 0.005 to 1 mass % of P based on 100 mass % of the iron-based soft magnetic powder.

9. The method of claim 1, wherein the non-hydrated phosphate conversion coating film comprises at least one element selected from the group consisting of Co, Na, S, Cs, and Al.

10. The method of claim 1, wherein the non-hydrated phosphate conversion coating film comprises 0.005 to 0.1 mass % of Co based on 100 mass % of the iron-based soft magnetic powder.

11. The method of claim 1, wherein the non-hydrated phosphate conversion coating film comprises 0.002 to 0.6 mass % of Na based on 100 mass % of the iron-based soft magnetic powder.

12. The method of claim 1, wherein the non-hydrated phosphate conversion coating film comprises 0.001 to 0.2 mass % of S based on 100 mass % of the iron-based soft magnetic powder.

13. The method of claim 1, wherein the non-hydrated phosphate conversion coating film comprises 0.002 to 0.6 mass % of Cs based on 100 mass % of the iron-based soft magnetic powder.

14. The method of claim 1, wherein the non-hydrated phosphate conversion coating film comprises 0.001 to 0.1 mass % of Al based on 100 mass % of the iron-based soft magnetic powder.

15. The method of claim 1, wherein the peak height for the absorption of hydroxyl groups formed at 3700 $cm^{-1}$ to 2500 $cm^{-1}$is 0.04 to 0.052.

* * * * *